United States Patent [19]

Eigner

[11] Patent Number: 4,485,975

[45] Date of Patent: Dec. 4, 1984

[54] ANCHORAGE OF THE LINER PLATES IN TUMBLING MILLS BY MEANS OF WEDGE-SHAPED ELEMENTS

[75] Inventor: Erich Eigner, Lödersdorf, Austria

[73] Assignee: Waagner-Biro Aktiengesellschaft, Austria

[21] Appl. No.: 370,410

[22] Filed: Apr. 21, 1982

[30] Foreign Application Priority Data

Apr. 27, 1981 [AT] Austria ..... 1873/81

[51] Int. Cl.[3] ..... B02C 17/22

[52] U.S. Cl. ..... 241/182; 51/164.1; 241/299

[58] Field of Search ..... 51/164 R, 422, 423; 241/182, 183, 299

[56] References Cited

U.S. PATENT DOCUMENTS 1,534,000 4/1925 Baker ..... 241/183

1,601,956 10/1926 Gammeter ..... 51/164

3,027,105 3/1962 Hall ..... 51/164.1

3,880,365 4/1975 Eigner ..... 241/182

FOREIGN PATENT DOCUMENTS 47-27175 of 1972 Japan ..... 51/164.1

*Primary Examiner*—Harold D. Whitehead

*Attorney, Agent, or Firm*—Steinberg & Raskin

[57] ABSTRACT

Apparatus for lining the shell of a tumbling mill and anchoring liner plates by wedge-shaped elements include a lining system including a plurality of spaced liner rings constituted by interfitted liner plates and securing rings each having a wedge-shaped cross-section and being situated between a pair of adjacent liner rings so that each liner ring is retained in position by a pair of securing rings and wherein the securing rings are fixed to the shell of the tumbling mill, such as by bolts or the like.

16 Claims, 5 Drawing Figures

ANCHORAGE OF THE LINER PLATES IN TUMBLING MILLS BY MEANS OF WEDGE-SHAPED ELEMENTS

BACKGROUND OF THE INVENTION

The present invention relates to apparatus for anchoring liner plates, defining cylindrical or polygonal grinding cross-sections, to the shell of a tumbling mill by means of bolts or the like.

It is a well known technique in the construction of tumbling mills to secure liner plates to the shell by means of bolts. However, this technique is not entirely satisfactory in that a large number of bolts must be used in view of the large number of liner plates and the bores formed in the liner plates for receiving the bolts must be precisely aligned with respect to the bolt arrangement provided on the tumbling mill shell. This results in difficulties arising during the original alignment of the liner plates as well as during the relining operation. Another disadvantage is that stress concentrations are created in the region of the bolt holes in the liner plates which result in early failure of the plates, especially where the tumbling mill is subjected to severe usage in operation.

In order to eliminate these disadvantages, it has been suggested to mount the liner plates in series by clamping one row of the liner plates to the tumbling mill shell and threadedly fastening the adjacent row of liner plates to the shell. In this connection, reference is made to CH-PS 272,033. However, this technique has been found disadvantageous in that the volume of the grinding chamber is determined by the configuration of the tumbling mill shell thereby limiting the grinding cross-sections to a circular configuration which therefore must be provided with lifting means. Although changes in the bolting arrangement can be made in the relining of this mill, the problem of stress concentrations arising during operation is still present.

SUMMARY OF THE INVENTION

It is an object of the present invention to provide new and improved apparatus for lining the shell of a tumbling mill which overcomes the drawbacks described above.

In accordance with the present invention, this object as well as others, is attained by providing securing ring means, each having a wedge-shaped cross-section and formed in segments. Each securing ring means is provided between spaced adjacent liner ring means which themselves are formed of liner plates. The securing ring means are affixed to the shell of the tumbling mill by means of bolts or the like.

The liner ring means formed of interfitted liner plates can define a substantially polygonal or circular grinding cross-section and may have obliquely extending side surfaces which cooperate with the wedge-shaped cross section of the securing ring means. The liner ring means preferably define a hollow space with the internal surface of the tumbling mill shell in which a hardening foam substance is provided. The segments of the securing ring means may be provided with lifting means in the form of lifting surfaces or protuberances extending inwardly therefrom. Moreover, the liner ring means may be angularly displaced one with respect to the next at substantially equal angles.

In a preferred embodiment, the liner ring means defines a substantially rectangular grinding cross-section having at least partially rounded corners which results in a regularity of grinding impacts as well as in the drive torque required during operation. Such a regularity in grinding impacts and drive torque is also obtained in an embodiment wherein the liner ring means defining a regular polygonal lining system are angularly displaced one with respect to the next by substantial equal, relatively small angles.

The liner ring means extend into the grinding chamber to an extent greater than the securing ring means so that the latter are recessed relative to the liner ring means. This arrangement is advantageous in that the fine media is extracted from the main grinding chamber area to prevent over grinding thereof and the friction occurring between the particles of the fine media results in a precise and autogenous grinding thereof and the consequent improvement in the grain distribution of the ground media.

The mixing of the media is also increased through the provision of lifting means, either in the form of lifting surfaces and/or protuberances, on the securing ring means.

Moreover, stress concentrations are reduced due to the surface contact presented by the wedge-shaped securing ring means on the adjacent liner ring means and at the same time the impact of the grinding media on the securing ring means is absorbed due to the recessed arrangement of the securing ring means thereby effectively eliminating rupture or breakage thereof. Furthermore, another advantage is obtained in that the use of spacers can be entirely eliminated or their size significantly reduced.

DESCRIPTION OF THE DRAWINGS

A more complete appreciation of the invention and many of its attendant advantages will be readily obtained by reference to the following detailed description when considered in connection with the accompanying drawings in which.

DESCRIPTION OF THE PREFERRED EMBODIMENTS

Figure 1:
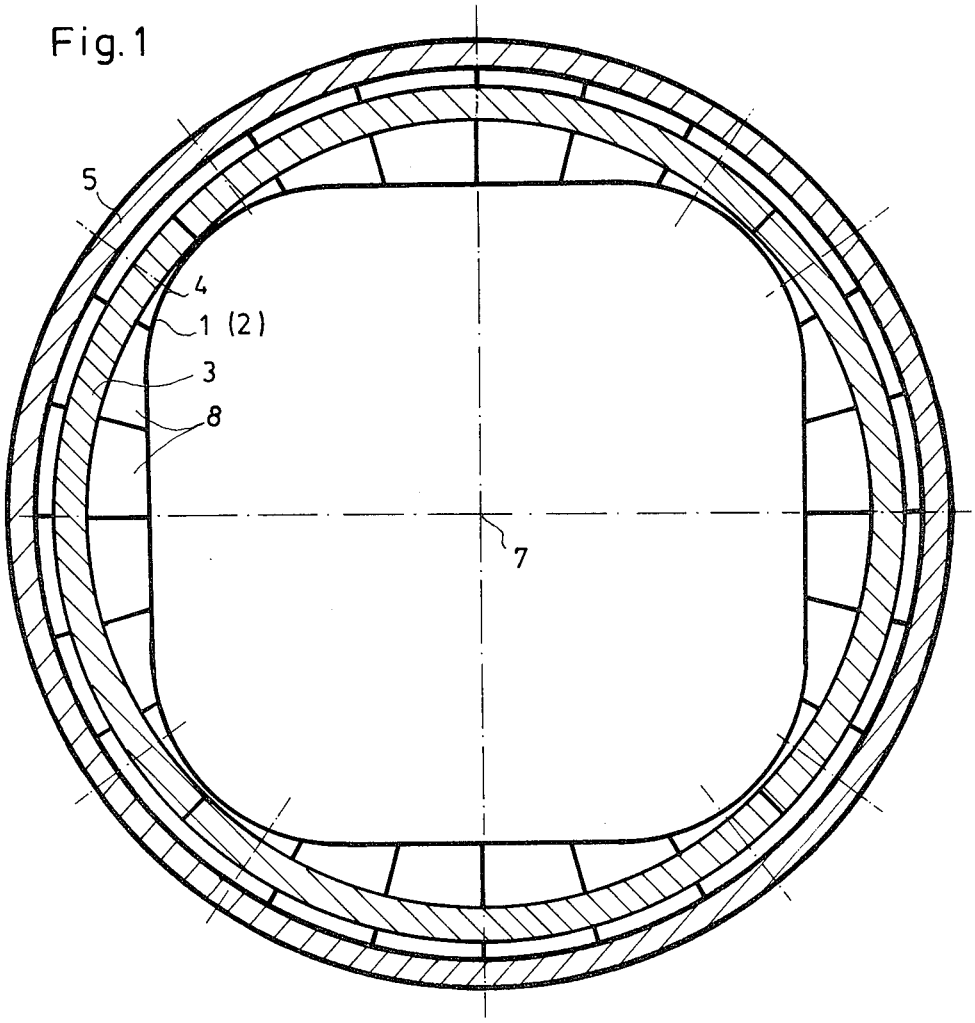
FIG. 1 is a transverse, cross-sectional view of a tumbling mill incorporating the present invention and having a rectangular grinding cross-section with rounded corners.
Figure 2:
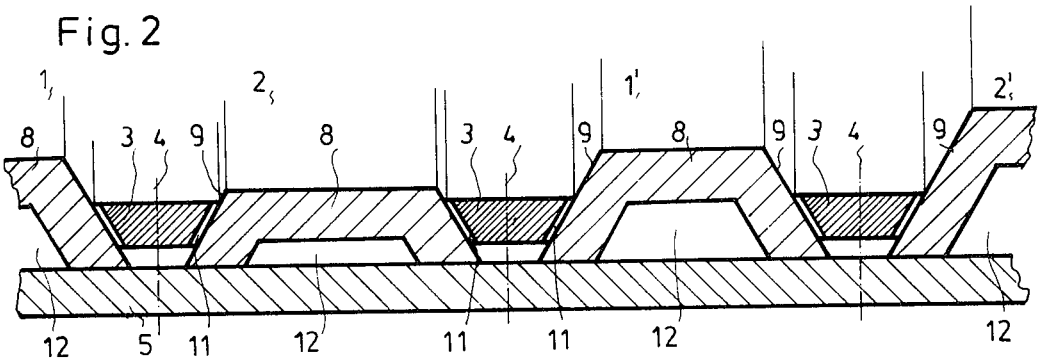
FIG. 2 is a longitudinal cross-sectional view of the lining and anchoring system of the present invention.
Figure 5:
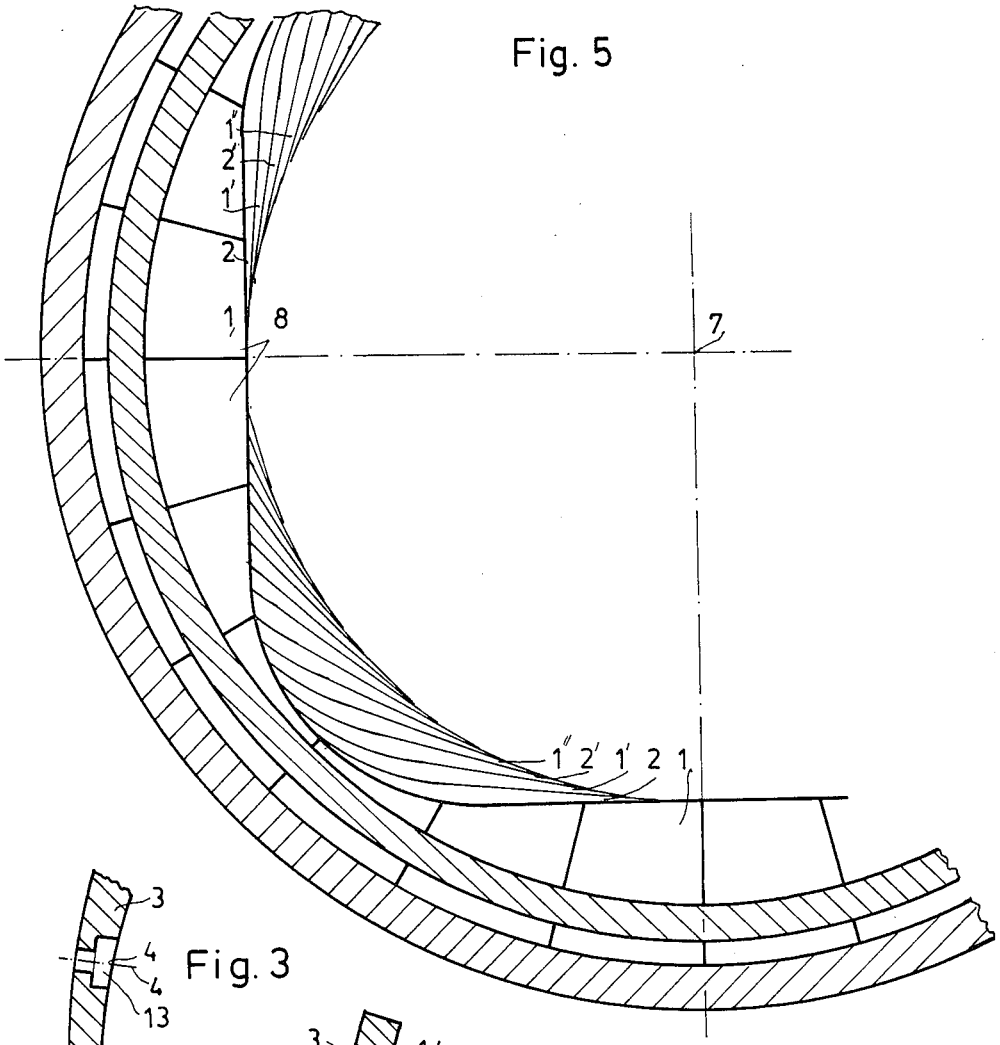
FIG. 5 is a view similar to FIG. 1 and illustrating the angular displacement of lining ring means.

Referring now to the drawings wherein like reference characters designate identical or corresponding parts throughout the several views, FIG. 1 is a transverse cross-sectional view of a tumbling mill having a substantially rectangular grinding cross-section with rounded corners. The lining ring means 1 (FIG. 2) are arranged parallel or substantially coextensive with each other although it is understood that the lining ring means may be angularly displaced relative to each other as seen in FIG. 5, discussed below. Thus, the lining system of the tumbling mill is formed of a plurality of substantially coaxial liner ring means 1, 2, each of the liner ring means being constituted by a plurality of liner plates 8. As seen in FIG. 2, the liner plates 8 have substantially U-shaped cross-sections having oblique side surfaces 9 which taper towards each other in the inward direction. This configuration is advantageous in that the grinding media is provided with an additional thorough mixing action during operation which is especially advantageous in the case of so-called wet grinding techniques.

The oblique or wedge-shaped surfaces 9 of the liner plates 8 are engaged by the side surfaces of wedge-shaped securing ring means 3 which themselves are fastened to the shell 5 of the tumbling mill by means of bolts designated by the center lines 4. In this connection, it is advantageous to provide a substantially elastic layer 11 (FIG. 2) between the wedge-shaped surfaces of the liner and securing ring means in order to accommodate any casting defects which might be present therein.

Figure 3:
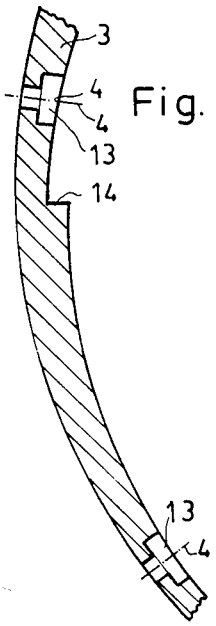
FIG. 3 is a longitudinal sectional view of one embodiment of a securing segment of securing ring means according to the present invention.
Figure 4:
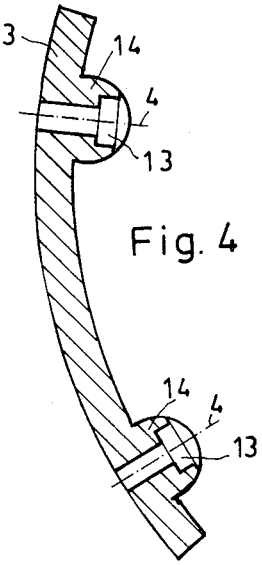
FIG. 4 is a view similar to FIG. 3 illustrating another embodiment of a securing segment of securing ring means according to the present invention.

The securing ring means 3 are constituted by a plurality of securing segments as seen in FIGS. 1, 3 and 4. In the embodiment illustrated in FIG. 1, each securing segment of the securing ring means 3 extends between adjacent corners of the rectangular-shaped grinding chamber defined by the liner ring means 1 and 2.

Protuberances and lifting bars are formed by the deviation in position of the surface of the inner ring relative to the circular cylindrical surface so that grinding media which is flowing between the liner ring means 1, 2 is moved out of the flowing direction thereby resulting in a relatively thorough mixing of the grinding media as well as an increase in turbulence and an improvement in grinding efficiency. At the same time, a separation of the fine and coarse grinding media occurs which reduces aggregations and over-grinding.

Thus, the liner ring means 1, 2 formed by the liner plates 8 are clamped to the inner surface of a shell 5 of the tumbling mill by means of the securing ring means 3 which themselves are fixed to the shell 5 by means of bolts 4. This is extremely advantageous in that such a clamping system permits a stepwise angular displacement of sequential liner ring means and the grinding cross-sections defined thereby which is irrespective and independent of the arrangement of the bolt bores provided in the tumbling mill shell 5. This fact permits mills having a polygonal lining to have a substantially equal moment distribution thereby resulting in an avoidance of load fluctuations during operation of the mill. Another important advantage is obtained in that if the angular position of the first liner ring means which corresponds to that of the last liner ring means of the grinding chamber and constitutes, for example, a multiple of 360°, the grinding cross-section can be formed by angularly displacing the liner ring means through an angle equal to a multiple of 360° divided by the number of corners of the polygonal shape of the grinding chamber.

Referring in particular to FIG. 2, a longitudinal section of a tumbling mill is illustrated wherein in accordance with the invention, three sequential liner ring means 1, 2, 1' are fastened to the tumbling mill shell 5 by means of the securing ring means 3 fixed to the shell 5 by means of bolts 4. The oblique, inwardly tapering side surfaces 9 of the respective line plates 8 are shown as having varying dimensions. Moreover, the angle of the wedge defined by the side surfaces of the securing ring means is preferably an acute angle and in this connection an angle of 20° has been found preferable. The hollow space 12 defined between the liner ring means formed of the liner plates 8 and the inner surface of the shell 5 is filled with a hardening foamable substance, such, for example, as a polyurethane foam in order to provide sound insulation.

Referring to FIGS. 3 and 4, individual securing segments of the securing ring means 3 are illustrated in longitudinal section. Differing from the embodiment illustrated in FIG. 1, the ring segments illustrated in FIGS. 3 and 4 are provided with protuberances and lifting surfaces 14 for additional distribution of fine ground media. As seen in FIGS. 3 and 4, bolt holes 13 are provided in the securing segments which are recessed or countersunk, preferably within the protuberances 14 in the case of the embodiment illustrated in FIG. 4, in order to protect the heads of the bolts from abrasion and the like.

Referring now to FIG. 5, a partial section of the tumbling mill is illustrated wherein the liner ring means are angularly displaced one with respect to the next. In particular, each liner ring means is angularly displaced by 5° with respect to the preceding one. Such angular displacement is made possible in a significantly more convenient manner than was previously possible by virtue of the clamping arrangement of the present invention.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for anchoring at least two liner ring means to a shell of a tumbling mill, comprising:

a plurality of liner plates arranged to define said at least two liner ring means, each liner ring means being situated contiguous and substantially coaxial with the tumbling mill shell in spaced relationship relative to each other and defining a substantially polygonal grinding cross-section;

securing ring means, each being situated contiguous and extending substantially coaxial with the tumbling mill shell and having a wedge-shaped cross-sectional in a plane containing the shell axis and a ring-shaped cross-section in a plane perpendicular to the shell axis, each securing ring means being situated between respective pairs of adjacent liner ring means so that each liner plate of one of said liner ring means is retained in position by a pair of securing ring means and each of said securing ring means being constituted by a plurality of securing segments which are fixed to the shell of the tumbling mill; and means for fixing said securing ring means segments to the shell of the tumbling mill.

2. The combination of claim 1 wherein said means for fixing said securing ring means to said tumbling mill shell comprises bolts.

3. The combination of claim 1 wherein each of said liner plates has obliquely extening side surfaces.

4. The combination of claim 1 wherein the angle of the wedge defined by side surfaces of said securing ring means is an acute angle.

5. The combination of claim 4 wherein the wedge angle is about 20°.

6. The combination of claim 1 wherein several liner plates are retained in position by a single securing segment of each of a pair of adjacent securing ring means.

7. The combination of claim 1 wherein said liner plates define a hollow space with the internal surface of said shell of the tumbling mill.

8. The combination of claim 7 wherein the hollow space is filled with a hardening foam substance.

9. The combination of claim 1 wherein a single securing segment of each of said securing ring means extends between adjacent corners of a grinding cross-section.

10. The combination of claim 1 wherein each of said segments are provided with means for lifting grinding media.

11. The combination of claim 10 wherein said lifting means comprise substantially radially extending lifting surfaces formed on said securing segments.

12. The combination of claim 10 wherein said lifting means comprise protuberances formed on said securing segments.

13. The combination of claim 1 wherein said liner ring means are angularly displaced one with respect to the next at substantially equal angles.

14. The combination of claim 13 wherein the grinding cross-section defined by said angularly displaced liner ring means is rotated through 360°.

15. The combination of claim 14 wherein said grinding cross-section has a substantially rectangular shape and said liner ring means are angularly displaced through a total angle of about 90°.

16. The combination of claim 1 wherein each of said securing means is constituted by a plurality of securing segments and wherein a layer of substantially elastic material is provided between each of said securing segments and said liner ring means adjacent thereto.

* * * * *